US007797894B1

(12) United States Patent
Sorkin

(10) Patent No.: US 7,797,894 B1
(45) Date of Patent: Sep. 21, 2010

(54) APPARATUS AND METHOD FOR PREVENTING SHRINKAGE OF A SHEATHING OVER A TENDON

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 391 days.

(21) Appl. No.: 11/874,087

(22) Filed: Oct. 17, 2007

Related U.S. Application Data

(63) Continuation-in-part of application No. 11/861,185, filed on Sep. 25, 2007.

(51) Int. Cl.
*E04C 5/08* (2006.01)

(52) U.S. Cl. ..... 52/223.13; 403/314; 403/367; 403/369; 403/374.1

(58) Field of Classification Search ..... 52/223.13; 403/367–369, 374.1, 365, 304, 314; 24/122.6, 24/459, 136 R, 122.3, 115 M
See application file for complete search history.

(56) References Cited

U.S. PATENT DOCUMENTS

| | | | | | |
|---|---|---|---|---|---|
| 274,796 | A | * | 3/1883 | Loehner | 403/314 |
| 309,142 | A | * | 12/1884 | Hyde | 403/369 |
| 833,548 | A | * | 10/1906 | Putnam | 403/368 |
| 1,074,839 | A | * | 10/1913 | Curry | 296/92 |
| 1,646,660 | A | * | 10/1927 | Prince | 439/805 |
| 1,997,649 | A | * | 4/1935 | Ohlund | 439/788 |
| 2,166,458 | A | * | 7/1939 | Berndt et al. | 439/788 |
| 2,699,589 | A | * | 1/1955 | Redell | 294/102.1 |
| 2,834,081 | A | * | 5/1958 | Stump, Jr. | 403/369 |
| 2,930,642 | A | * | 3/1960 | Howlett | 403/314 |
| 2,984,881 | A | * | 5/1961 | Greer | 403/16 |
| 3,163,904 | A | * | 1/1965 | Ziolkowski | 403/365 |
| 3,253,332 | A | * | 5/1966 | Howlett et al. | 29/506 |
| 3,534,989 | A | * | 10/1970 | Yonkers | 403/369 |
| 3,596,330 | A | * | 8/1971 | Scott et al. | 24/122.3 |
| 3,698,749 | A | * | 10/1972 | Yonkers | 403/197 |
| 3,912,406 | A | * | 10/1975 | McGrath | 403/19 |
| 4,146,951 | A | * | 4/1979 | Howlett | 29/452 |
| 4,494,890 | A | * | 1/1985 | Lusk | 403/267 |
| 4,619,088 | A | * | 10/1986 | Ripoll Garcia-Mansilla | 52/223.13 |
| 4,623,277 | A | * | 11/1986 | Wayne et al. | 403/314 |
| 5,141,356 | A | * | 8/1992 | Chaize | 403/368 |
| 5,163,775 | A | * | 11/1992 | Rowan, Jr. | 403/301 |
| 5,374,135 | A | * | 12/1994 | Folsom et al. | 403/369 |
| 5,469,677 | A | * | 11/1995 | Luthi | 52/223.13 |
| 5,630,301 | A | * | 5/1997 | Sieg | 52/223.13 |
| 5,729,938 | A | * | 3/1998 | Tobias | 52/220.8 |
| 5,770,286 | A | | 6/1998 | Sorkin | |
| 5,839,235 | A | | 11/1998 | Sorkin | |
| 5,897,102 | A | * | 4/1999 | Sorkin | 254/29 A |
| 6,098,356 | A | | 8/2000 | Sorkin | |
| 6,151,850 | A | * | 11/2000 | Sorkin | 52/223.13 |
| 6,381,912 | B1 | | 5/2002 | Sorkin | |

(Continued)

*Primary Examiner*—Brian E Glessner
(74) *Attorney, Agent, or Firm*—Egbert Law Offices PLLC

(57) ABSTRACT

An apparatus for preventing shrinkage of a sheathing of a tendon has an anchor body having a cavity formed in an interior thereof, a tendon extending into the cavity, a fixing element engaged with the sheathing for fixing a position of the sheathed portion on the tendon, and a pair of wedges in engagement with the unsheathed portion of tendon in the cavity of the anchor body. The fixing element is positioned away from the cavity of the anchor body. An encapsulation is formed over the anchor body so as to define a trumpet extending outwardly from one side of the anchor body. A clamp is engaged with the sheathed portion of the tendon within the trumpet.

9 Claims, 2 Drawing Sheets

U.S. PATENT DOCUMENTS

| | | | | |
|---|---|---|---|---|
| 6,513,287 | B1 | 2/2003 | Sorkin | |
| 6,631,596 | B1 | 10/2003 | Sorkin | |
| 6,817,148 | B1 | 11/2004 | Sorkin | |
| 2003/0159377 | A1* | 8/2003 | Marshall | 52/223.13 |
| 2003/0159395 | A1* | 8/2003 | Dahl | 52/726.1 |
| 2004/0148881 | A1* | 8/2004 | Hayes | 52/223.13 |

* cited by examiner

APPARATUS AND METHOD FOR PREVENTING SHRINKAGE OF A SHEATHING OVER A TENDON

CROSS-REFERENCE TO RELATED APPLICATIONS

The present application is a continuation-in-part of U.S. application Ser. No. 11/861,185 filed on Sep. 25, 2007, and entitled "Apparatus for Preventing Shrinkage of a Sheathing Over a Tendon", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post-tension anchor systems. More particularly, the present invention relates to anchors used in such post-tension systems. More particularly, the present invention relates to devices and methods used to prevent shrinkage of a sheathing that extends over the tendon.

2. Description of Related Art Including Information Disclosed Under 37 CFR 1.97 and 37 CFR 1.98.

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes required for by engineering and design specifications. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation.

After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult since the tendon can have a considerable length and since the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism has a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, are tightly wound around a spool. During shipment, the tight winding of the tendon around the spool will mechanically resist any shrinking of the sheathing over the lubricated exterior of the steel cable on the interior of the tendon. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead end anchorage, the end of the sheathing will tend to the shrink slowly away from the dead end anchorage.

The problem that affects many anchorage system is the inability to effectively prevent liquid intrusion into this area of the unsheathed portion. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the tubular body. A corrosion-resistant material is contained within the interior area of the cap. This surface closes the end of the tubular body. A frangible area is formed on this surface The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

As can be seen, there is a great deal of technology associated with this need to accommodate the shrinkage of the sheathing over the cable of the tendon of the post-tension anchor system. Each patent associated with this technology suggests the placement of an additional tube over the polymeric encapsulation and additional materials for sealing the unsheathed portion of the tendon which extends outwardly of the anchor. In certain circumstances, these tubes are sometimes improperly installed and, at best, are simply an additional component that needs to be associated with the post-tension system. As such, it adds additional costs and can require additional labor associated with the installation of the sealing tube. A need has thus developed so as to avoid the use of such a tube with the dead-end anchor of a post-tension anchor system.

It is an object of the present invention to provide an apparatus which effectively prevents shrinkage of the sheathing at the anchor of a post-tension anchor system.

It is another object of the present invention to provide an apparatus that can be easily installed during the installation of the wedges associated with the anchorage of a post-tension anchor system.

It is a further object of the present invention to provide an apparatus which effectively engages the sheathing at the anchorage so as to resist shrinkage forces associated with the sheathing.

It is still another object of the present invention to provide an apparatus which resists the shrinkage of the sheathing of a tendon of a post-tension anchor system which is easy to install, relatively inexpensive and easy to manufacture.

These and other objects and advantages of the present invention will become apparent from a reading of the attached specification and appended claims.

BRIEF SUMMARY OF THE INVENTION

The present invention is an apparatus that comprises an anchor body having a cavity formed in an interior thereof, a tendon extending into the cavity, a fixing means engaged with the sheathing for fixing a position of the sheathed portion on the tendon, and a pair of wedges in engagement with the unsheathed portion of the tendon in the cavity of the anchor body. As such, the tendon has a sheathed portion and an unsheathed portion. The fixing means is positioned away from the cavity of the anchor body.

In particular, the present invention includes an encapsulation in surface-to-surface sealing contact with an exterior surface of the anchor body. The encapsulation has a trumpet extending outwardly at one side of the anchor body. This trumpet is co-axial with the cavity. The fixing means includes a clamp engaged with the sheathed portion of the tendon within the trumpet. The trumpet has a slot formed through a wall thereof. The clamp extends through this slot so as to engage with the sheathed portion. The slot extends transverse to a longitudinal axis of the trumpet. The clamp has a U-shaped configuration. This clamp has an inner edge in engagement with the sheathed portion. Alternatively, in addition, the clamp is in interference-fit relation between an outer surface of the sheathed portion and an inner wall of the trumpet.

An annular seal extends around the sheathed portion of the tendon in liquid-tight sealing relationship therewith. The annular seal is positioned between the fixing means and the cavity of the anchor body. The annular seal extends around an inner wall of the trumpet.

The present invention is also a method of forming a dead-end anchorage including the steps of: (1) inserting a tendon through the cavity of the anchorage so as to have an unsheathed portion residing in the cavity and a sheathed portion extending outwardly of the cavity; (2) placing wedges in the cavity in interference-fit relationship with the unsheathed portion of the tendon; (3) and clamping the sheathed portion of the tendon against a wire bundle of the tendon so as to resist a shrinkage force of more than 100 pounds. The method of the present invention further includes forming the encapsulation so as to have a trumpet extending outwardly of the anchorage. The sheathed portion of the tendon resides within the trumpet. The step of clamping includes placing a clamp onto the sheathed portion of the tendon within the trumpet. In particular, the clamp is pushed through the slot of the trumpet such that the clamp bites into the sheathing of the sheathed portion. A seal is formed between an outer surface of the sheathed portion and an inner wall of the trumpet in a position between the clamp and the anchorage.

DETAILED DESCRIPTION OF THE INVENTION

Figure 1:
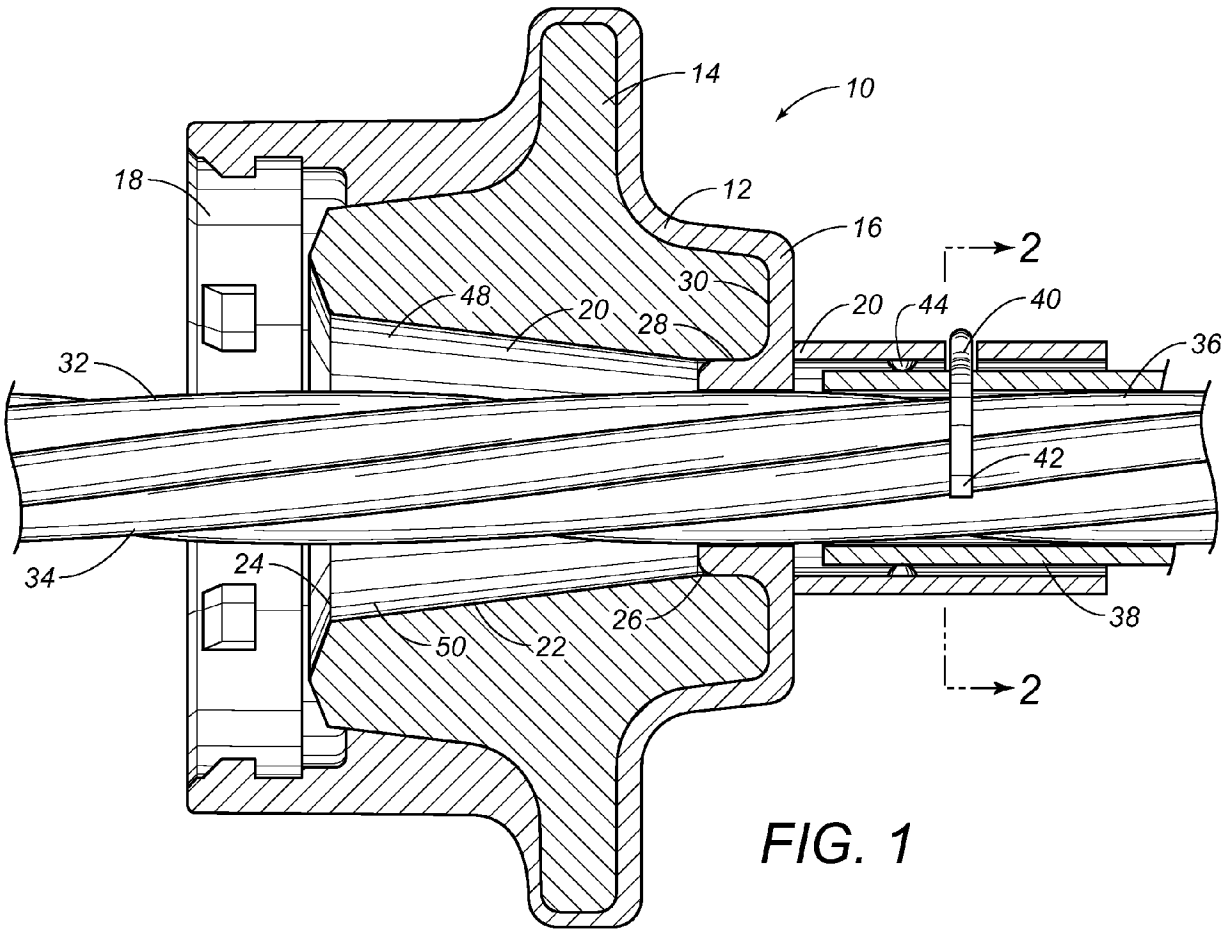
FIG. 1 is a cross-sectional view of the apparatus of the present invention.

Referring to FIG. 1, there is shown the apparatus 10 for the resisting of the shrinkage of a sheathing of a tendon in a post-tension anchor system. In particular, the apparatus 10 shows the anchorage 12. The anchorage 12 includes an anchor body 14 with a polymeric encapsulation 16 extending thereover and therearound. The polymeric encapsulation 16 is in liquid-tight sealing relationship with the anchor body 14. The encapsulation 16 is formed over the anchor body 14 by an injection-molding process. A cap-receiving opening 18 is formed at one end of the polymeric encapsulation 16. A trumpet 20 is formed at the opposite end of the polymeric encapsulation 16. The trumpet 20 is a tubular section that extends outwardly of the end of the anchorage 12 for a short distance. The anchor body 14 is a steel anchor. The anchor body 14 has a cavity 22 formed in an interior thereof. The cavity 22 has tapered walls having a wide end 24 and a narrow end 26. The wide end 24 opens at an end of the anchor body 14. The narrow end 26 opens on the interior of the cavity 22.

A passageway 28 extends from the narrow end 26 of cavity 22 to the opposite end 30 of the anchor body 14.

A tendon 32 extends entirely through the cavity 22 of the anchor body 14. The tendon 32 also extends through the trumpet 20 of the polymeric encapsulation 16. The tendon 32 has an unsheathed portion 34 and a sheathed portion 36. Sheathing 38 extends over the wire bundle of the tendon 32. Typically, a lubricant will be applied between the exterior surface of the wire bundle of tendon 32 and the inner surface of the sheathing 38.

In the present invention, a fixing means 40 is positioned in the trumpet 20 and into engagement with the sheathing 38 on the interior of the trumpet 20. The fixing means 40 serves to engage the sheathing so as to strongly fix a position of the sheathing 38 on the wire bundle of tendon 32.

In FIG. 1, it can be seen that the fixing means 40 includes a clamp 42 that extends in generally transverse relationship to the longitudinal axis of the trumpet 20. The longitudinal axis of the trumpet 20 is coaxial with the longitudinal axis of the cavity 22. As will be illustrated in later drawings, the inner surface of the clamp 42 bites into the sheathing 38 and is retained in position within the trumpet 20 so as to prevent the sheathing 38 from shrinking away from its fixed position within the trumpet 20. An annular seal 44 extends around the inner wall of the trumpet 20 so as to be in liquid-tight sealing contact with outer surface of the sheathing 38. This annular seal 44 can be in the nature of an elastomeric O-ring that is fixedly positioned within the interior of the trumpet 20. Alternatively, the seal 44 can be integrally formed with the trumpet 20 during the injection molding of the polymeric encapsulation 16 over anchor body 14. The seal 44 is placed between the clamp 42 and the end 30 of anchor body 14. As such, the annular seal 44 serves to prevent liquid intrusion into the interior of the anchor body 14.

It should be noted that the fixing means 40 can ultimately reside in interference-fit relationship with the interior of the trumpet 20. When there is a tensioning of the tendon 32, the clamp 40 can deflect so as to wedge within the interior surface of the trumpet 20 between inner wall of the trumpet 20 and the outer surface of the sheathing 38. Once again, this interference-fit relationship between the fixing means 40 and the sheathing 38 will prevent any shrinking effects from causing the sheathing to pass outwardly of the trumpet 20 or away from the annular seal 44.

The engagement of the fixing means 40 with the sheathing 38 is extremely effective in preventing the shrinkage of the sheathing 38. Typically, the force of shrinkage is between 100 and 150 pounds. Although the engagement of the clamp 42 with the sheathing 38 would appear to be rather weak, the resistance to shrinkage forces is actually sufficient to prevent the shrinkage of the sheathing 38. Through the use of the fixing means 40 and the annular seal 44, the present invention avoids the use of any sealing tubes that are affixed over, under or around the trumpet 20 of the encapsulation 16. Taping, or other forms of sealing, are also unnecessary with the configuration of the apparatus 10 of the present invention.

Figure 2:
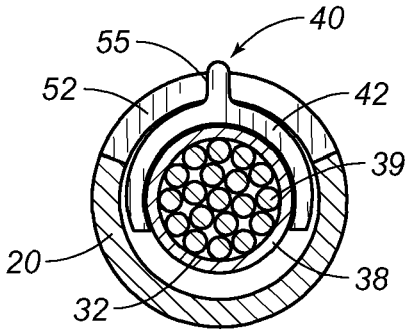
FIG. 2 is a cross-sectional view taken across lines 2-2 of FIG. 1.

FIG. 2 illustrates the manner in which the clamp 42 of the fixing means 40 serves to retain the sheathing 38 in a fixed position around the wire bundle 39 of the tendon 32. The clamp 42 is a U-shaped clamp with rather sharp inner edge. When the clamp 42 is inserted through the slot 52 of trumpet 20, the inner edges of the clamp 42 will bite into the sheathing 38 while the outer edges of the clamp 42 will be urged against the inner wall of the trumpet 20. Any force that is applied to the stem 55 of the clamp 42 will further urge the U-shaped portion into strong biting engagement with the sheathing 38.

Figure 3:
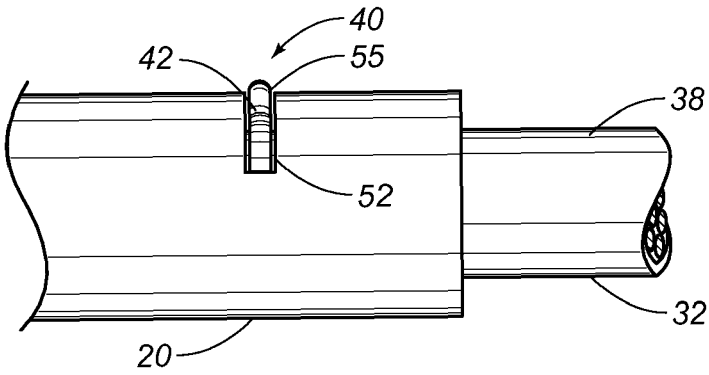
FIG. 3 is an isolated side elevational view showing the placement of the clamp into the slot of the trumpet of the encapsulation.

FIG. 3 further illustrates the manner in which the fixing means 40 is received within the slot 52 of trumpet 20. The slot 52 extends generally transverse to the longitudinal axis of the trumpet 20. Slot 52 can extend for approximately half the diameter of the trumpet 20. The size of the slot 52 facilitates the ability to strongly install the clamp 42 into its desired position. Hammers, or other devices, can be applied to the stem 55 of clamp 42 so as to insure a proper strong biting engagement between the inner edges of the clamp 42 and the outer surface of the sheathing 38 of tendon 32.

Figure 4:
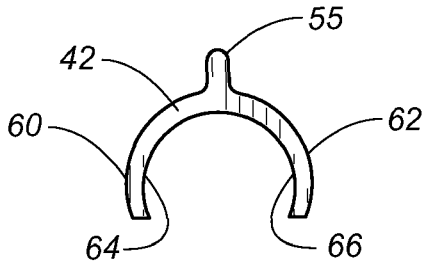
FIG. 4 is a frontal view of the clamp as used in the preferred embodiment of the present invention.

FIG. 4 illustrates an isolated view of the clamp 42 as used in the fixing means 40 of the present invention. Clamp 42 has an inverted U-shaped configuration with legs 60 and 62 and the stem 55. Legs 60 and 62 have respective inner edges 64 and 66. The inner edges 64 and 66 can be relatively sharp so as to facilitate the ability to engage the sheathing 38. Each of the legs 60 and 62 is slightly tapered so that when more force is applied to the stem 55, the legs 60 and 62 will push further into the space between the inner wall of the trumpet 20 and the outer surface of the sheathing 38. Additionally, this tapered arrangement will further facilitate the ability for the clamp 42 to enter into an interference-fit type of relationship between the inner wall of the trumpet 20 and the exterior surface of the sheathing 38.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

An anchor body having a cavity formed in an interior thereof;

an encapsulation in surface-to-surface sealing contact with an exterior surface of said anchor body, said encapsulation having a tubular trumpet extending outwardly at one side of said anchor body, said tubular trumpet being coaxial with said cavity, said tubular trumpet having a slot formed through a wall thereof;

a tendon extending into said cavity, said tendon having a sheathing extending at least partially thereover, said tendon having a sheathed portion and an unsheathed portion, said unsheathed portion positioned in said cavity, said sheathed portion extending through said tubular trumpet;

a clamp extending through said slot so as to engage with said sheathed portion, said clamp suitable for fixing a position of said sheathing on said tendon; and a pair of wedges in frictional engagement with said unsheathing portion of said tendon in said cavity of said anchor body.

2. The apparatus of claim 1, said slot extending transverse to a longitudinal axis of said trumpet.

3. The apparatus of claim 1, said clamp being of a generally U-shaped configuration, said clamp having an inner edge in biting engagement with said sheathed portion.

4. The apparatus of claim 1, said clamp being in interference-fit relationship between an outer surface of said sheathed portion and an inner wall of said trumpet.

5. The apparatus of claim 1, further comprising:

an annular seal extending around said sheathed portion of said tendon in liquid-tight sealing relationship therewith, said annular seal positioned between said clamp and said cavity of said anchor body.

6. The apparatus of claim 5, said annular seal extending around an inner wall of said trumpet.

7. An apparatus comprising:

an anchor body having a cavity formed in an interior thereof;

a tendon extending into said cavity, said tendon having a sheathing extending at least partially thereover, said tendon having a sheathed portion and an unsheathed portion;

an encapsulation extending over an exterior surface of said anchor body, said encapsulation having a trumpet extending outwardly of one side of said anchor body, said trumpet being coaxial with said cavity; and a clamp engaged with said sheathed portion of said tendon within said trumpet, said clamp suitable for fixing a position of said sheathing with respect to said tendon, said trumpet having a slot formed through a wall of said trumpet, said clamp extending through said slot so as to engage with said sheathed portion, said clamp having a generally U-shaped configuration, said clamp having an inner edge in biting engagement of said sheathed portion.

8. The apparatus of claim 7, further comprising:

an annular seal extending around said sheathed portion of said tendon in liquid-tight relationship therewith, said annular seal interposed between an inner wall of said trumpet and an exterior surface of said sheathing.

9. The apparatus of claim 8, said annular seal being an elastomeric seal positioned away from said anchor body.

* * * * *